United States Patent [19]

Kenyon

[11] 4,030,321

[45] June 21, 1977

[54] PADLOCK WITH PROTECTED SLIDE BOLT AND LOCKING MEANS

[76] Inventor: David L. Kenyon, 1727 W. Royalton Road, Broadview Heights, Ohio 44147

[22] Filed: June 16, 1976

[21] Appl. No.: 696,840

[52] U.S. Cl. ..... 70/34; 70/54; 70/38 L

[51] Int. Cl.[2] ..... E05B 67/36

[58] Field of Search ..... 70/6–12, 70/32–34, 54–56, 229–232, 38 L

[56] References Cited

UNITED STATES PATENTS

| | | | |
|---|---|---|---|
| 924,331 | 6/1909 | Feola | 70/32 |
| 2,514,523 | 7/1950 | Stanley | 70/33 |
| 3,525,242 | 8/1970 | Young | 70/231 |
| 3,817,062 | 6/1974 | Randel | 70/11 |

*Primary Examiner*—Robert L. Wolfe
*Attorney, Agent, or Firm*—Bosworth, Sessions & McCoy

[57] ABSTRACT

A padlock is disclosed having an outer case preferably of hardened steel and having no shackle or bow which can be sawed or broken off. The case has an opening for insertion of a staple and has a slide bolt which extends through the opening to engage the staple. The slide bolt is secured by a locking means which includes a lock sleeve located within a cylindrical bore in the case, the sleeve being movable between a locked position and an unlocked position. The slide bolt is attached to the sleeve and extends through the opening when the sleeve is in the locked position. The lock sleeve has a retractable locking member projecting from a hole in the wall of the sleeve. The locking member is capable of fitting within an indentation in the interior bore wall when in the locked position to hold the sleeve in the locked position and capable of retracting into the hole to free the sleeve when in the unlocked position. A lock cylinder is fixedly mounted within the shell. The cylinder has an interior locking mechanism operatively connected to a camming means for forcing the locking member to project outwardly through the hole when the locking mechanism is locked and allowing the locking member to retract inwardly when the mechanism is unlocked.

8 Claims, 10 Drawing Figures

PADLOCK WITH PROTECTED SLIDE BOLT AND LOCKING MEANS

FIELD OF THE INVENTION

This invention relates to locking devices, and specifically to a padlock of the type commonly used to lock a hasp.

BACKGROUND OF THE INVENTION

Padlocks are commonly used to lock a hasp having a slot through which there is a projecting staple. The typical design of prior art padlocks includes a shackle or bow which fits through the loop of the staple and prevents the staple from removal through the hasp. The padlock case usually has within it a lock cylinder with a keyway or combination tumbler device with a latching mechanism to latch the end of the shackle and prevent its removal from the case.

The prior art padlocks have had features which allow the lock to be broken open, since the shackle can usually be sawed off or broken off to open the lock. Even if the shackle cannot be broken, it is possible to saw or break off the exposed staple.

Another problem with prior art padlocks involves the latching mechanism which holds the end of the shackle within the case. After a period of time, such latching mechanisms can become susceptible to jamming, preventing one from opening of the lock with a key.

SUMMARY OF THE INVENTION

The disadvantages of prior art padlocks are overcome by the improved padlock of the present invention. It is an object of the present invention to provide a padlock without a shackle or bow which can be sawed or broken off. Another object is to provide a padlock with a solid, smooth, outer case preferably of hardened steel which has no internal latches or levers likely to jam and which has a smooth surface which frustrates attempts to pry open the case. Still another object is to provide a padlock with a case which is adapted to fit completely around a staple preventing access to the staple.

These and other objects are accomplished by the improved padlock of the present invention which has a smooth solid case which fits over the staple and has an opening for insertion of the staple. A slide bolt, secured by locking means within the case, extends through the opening to engage the staple. The locking means includes a lock sleeve mounted within a cylindrical bore in the case, which sleeve is movable between a locked position and an unlocked position. The slide bolt is attached to the lock sleeve, and extends through the opening when the sleeve is in the locked position. A retractable locking member, which projects from a hole in the wall of the sleeve, is capable of fitting within an indentation in the interior bore wall to hold the sleeve in the locked position and is capable of retracting into the hole to free the sleeve when in the unlocked position. A lock cylinder is fixedly mounted within the sleeve and has an interior locking mechanism operatively connected to a camming means for forcing the locking member outwardly through the hole when the locking mechanism is locked and allowing the locking member to retract inwardly when the mechanism is unlocked.

DETAILED DESCRIPTION OF THE PREFERRED EMBODIMENT

Figure 1:
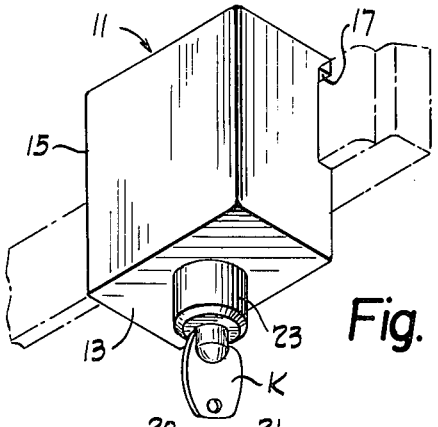
FIG. 1 is a perspective view of the padlock of the present invention mounted over a hasp and staple with a key inserted and the lock in the unlocked position.
Figure 2:
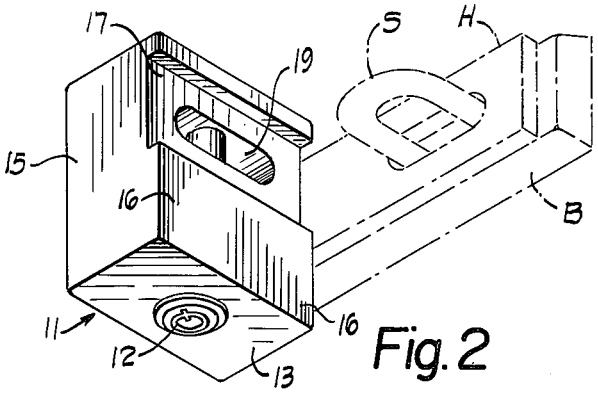
FIG. 2 is a perspective view of the lock of FIG. 1 removed from the hasp and staple with the key removed and the lock in the locked position.
Figure 9:
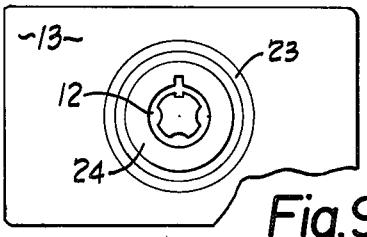
FIG. 9 is a bottom plan view taken along line 9—9 of FIG. 3.

Referring more particularly to the drawings and initially to FIGS. 1 and 2, there is shown a padlock 11 of the present invention. The padlock 11 is specifically designed for locking a hasp H by attachment to a staple S which projects from a bar B and fits through the slot in the hasp H. The padlock 11 has a keyway 12 along its bottom surface 13 (FIG. 9), adaptable for insertion of a key K (FIG. 1).

Figure 3:
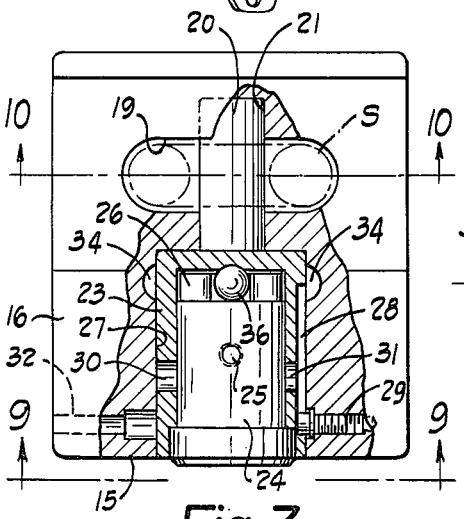
FIG. 3 is a rear elevational view of the padlock in the locked position.
Figure 4:
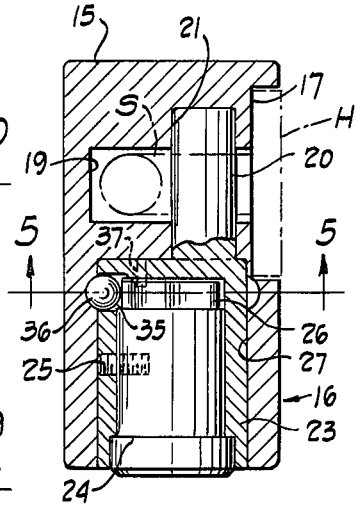
FIG. 4 is a side elevational view of the padlock of FIG. 3 with portions in section.
Figure 5:
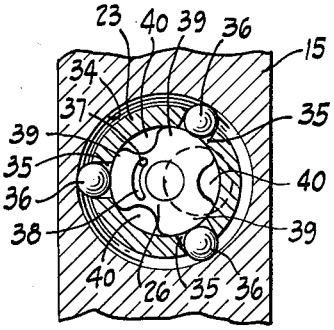
FIG. 5 is a sectional view taken along line 5—5 of FIG. 4.

The interior of the padlock 11 is shown in more detail in FIGS. 3–5. The body of the padlock 11 comprises a case 15, preferably of hardened steel with smooth outer surfaces. The rearward surface 16 of the case 15, which fits against the hasp H and the staple S, has formed therein a transverse rectangular recess 17 into which the hasp H fits (FIG. 4). An opening 19, capable of receiving the projecting staple S, extends into the padlock case 15 from the recess 17.

Figure 10:
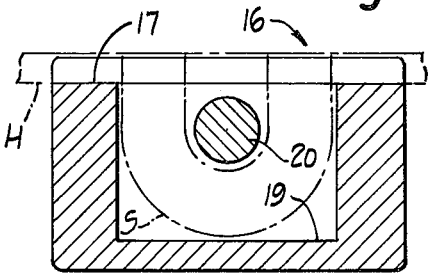
FIG. 10 is a sectional view taken along line 10—10 of FIG. 3.

To lock the staple S, a slide bolt 20 extends upwardly through the opening 19 and through the loop of the staple S (FIG. 10). The slide bolt 20 is movable within a passage 21 in the case 15 (FIGS. 3 and 4). The top of the passage 21 extends through the opening 19, so that when the slide bolt 20 is fully extended within the passage 21, the staple S is effectively secured by the padlock and the hasp H is incapable of removal from the staple.

The slide bolt 20 is secured within the passage 21 by the operation of a locking means comprising an attached lock sleeve 23 and lock cylinder 24. The slide bolt 20 is mounted to the upper end of the cylindrical lock sleeve 23, which is hollow and which has a lock cylinder 24 securely mounted within it by means of a removable set screw 25. The lock cylinder 24 is of conventional design comprising a nonrotatable outer housing which is secured to the lock sleeve 23 by the set screw 25, and a conventional internal locking mechanism which is capable of turning only when a key is inserted into the keyway 12, activating tumblers in the internal locking mechanism. A rotatable camming disk 26 is connected to the internal locking mechanism and is mounted at the upper end of the lock cylinder 24. By inserting the key K into the keyway 12 and turning the key, the tumblers are activated, and the locking mechanism turns resulting in rotation of the connected camming disk 26.

The assembly of the lock sleeve 23 and the attached lock cylinder 24 is slidable within a cylindrical bore 27 in the case 15. To restrain the assembly within the bore 27, the lock sleeve 23 has a longitudinal groove 28 along its side (FIG. 3). A retaining member, such as pin or screw 29, is mounted in the wall of the bore 27 and fits within the groove 28. As the sleeve 23 slides within the bore 27, the screw 29 moves within the longitudinal groove 28, preventing the sleeve from being fully removed from the bore 27. To permit installation and removal of the screw 29, the sleeve 23 has a pair of radially extending holes 30 and 31 which extend through the wall of the sleeve. Holes 30 and 31 are coaxial with each other, and the hole 31 communicates directly with groove 28. A hole 32 is also formed through the case 15 coaxial with the screw 29.

Figure 8:
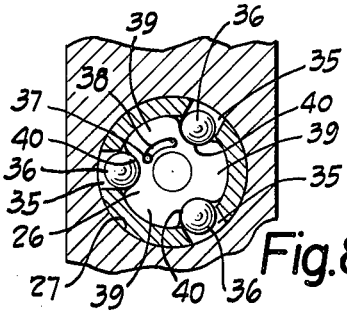
FIG. 8 is a sectional view taken along line 8—8 of FIG. 7.
Figure 7:
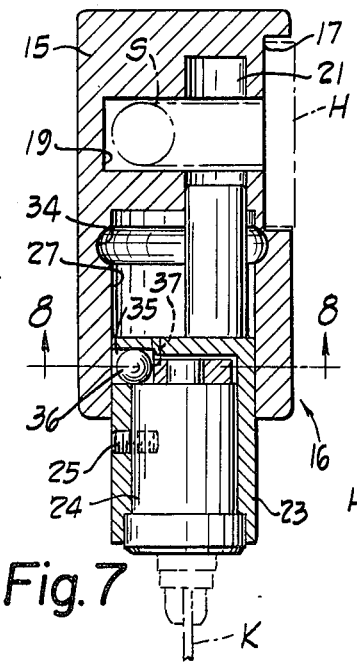
FIG. 7 is a side elevational view of the lock of FIG. 6 with portions in section.

To provide a means by which the sleeve 23 and attached lock cylinder 24 are locked within the bore 27, an annular indentation 34 extends into the case 15 from the interior bore wall around the top of the bore 27. A plurality of holes 35 extend through the wall of the lock sleeve 23 around its upper portion. A retractable locking member, preferably a ball bearing 36, is placed in each of the holes 35. In the preferred embodiment of the present invention, three holes 25 each containing a bearing 36 are provided (FIG. 5). The lock cylinder 34 secured within the sleeve 23 has mounted at its upper end a camming means, such as the rotatable camming disk 26, having projections 39 and recesses 40. The camming disk 26 is capable of rotating only when the key and the internal locking mechanism of the lock cylinder 24 rotates. The motion of the camming disk 26 is restrained by a pin 37 which projects from the top surface of the interior of the lock sleeve 23 and which engages an arcuate slot 38 on the top of the camming disk 26. The number of projections 39 and recesses 40 on the camming disk 26 corresponds to the number of bearings 36 within the holes 35 of the sleeve 23. The recesses 40 are proportioned such that, when the recesses 40 are adjacent the holes 35, the bearings 36 fit within the recesses 40 and do not project from the outer surface of the sleeve 23 (FIG. 8). However, when the projections 39 of the camming disk 26 are opposite the holes 35, the bearings 36 project outwardly through the holes 36 beyond the outer surface of the sleeve 23 (FIG. 5). When the sleeve 23 is in the locked position, the projecting bearings 36 fit within the annular indentation 34 in the bore 27 (FIG. 4). When the sleeve 23 is in the unlocked position, the bearings 36 retract within the sleeve 23 and the sleeve is movable within the bore 27 (FIG. 7).

Figure 6:
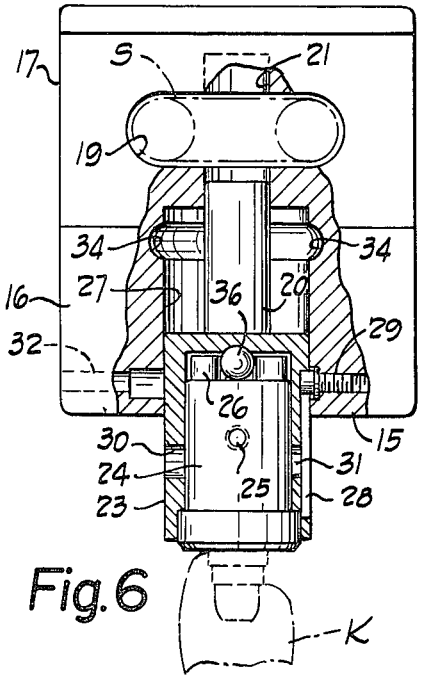
FIG. 6 is a rear elevational view similar to FIG. 3 showing the padlock in the unlocked position.

To operate the padlock 11 of the present invention, a key K is placed within the keyway 12 of the lock cylinder 24, and the key is turned. The key activates the tumblers within the lock cylinder 24 and allows the internal locking mechanism to turn, thereby rotating the camming disk 26 mounted on the upper end of the lock cylinder. The nonrotatable outer portion of the lock cylinder 24 remains fixedly secured to the lock sleeve 23 by set screw 25. As the camming disk 26 is rotated, the projections 39 in the disk move away from the holes 35 in the sleeve 23 and the recesses 40 move into a position adjacent the holes 35 (FIGS. 5 and 8). This allows the bearings 36 to retract into the holes 35 and clear of the annular recess 34. With the bearings 36 removed from the recess 34, the lock sleeve 23 is free to slide within the bore 27 (FIGS. 6 and 7), restrained only by the screw 29 within the groove 28 of the lock sleeve. The lock sleeve 23 and attached lock cylinder 24 can then be pulled downwardly beyond the bottom surface 13 of the case 15. (See FIG. 11). The slide bolt 20 attached to the upper end of the lock sleeve 23 also moves downwardly through its passage 21 until it is completely clear of the opening 19 (FIGS. 6 and 7). The staple S is then free to be removed from the opening 19. The outward extension of the lock sleeve 23, (FIG. 1) provides an easy visual indication that the padlock is unlocked, thereby avoiding the possibility of inadvertently leaving the padlock unlocked. The reverse procedure is used to lock the padlock with the staple S reinserted into the opening 19.

Another feature of the padlock of the present invention is that the elements can be disassembled to replace worn or defective parts, but only when the padlock 11 is in the unlocked position. To remove the lock cylinder 24 from the lock sleeve 23, the padlock is first unlocked so that the sleeve 23 slides downwardly through the bore 27 and projects from the lower surface 13 of the lock case 15. In this position (FIGS. 6 and 7), the head of the set screw 25 is accessible. Removal of the set screw 25 permits removal of the lock cylinder 24 from the lock sleeve 23. With the lock cylinder 24 removed, the sleeve 23 can be pushed back into the bore partially so that the hole 32 in the case 15 is aligned with the holes 30 and 31 in the sleeve 23. In this position, a small screwdriver or socket wrench can be inserted through the aligned holes 30, 31 and 32 to remove the screw 29. With screw 29 removed, the lock sleeve 23 is no longer restrained with the bore 27, and it can be easily removed from the case 15. It can be seen that, when the lock sleeve 23 is completely removed from the hole 27, the bearings 36 which are placed within the holes 35 also easily removable.

While the invention has been shown and described with respect to a specific embodiment thereof, this is intended for the purpose of illustration rather than limitation, and other modifications and variations will be apparent to those skilled in the art, all within the intended spirit and scope of the invention.

What is claimed is:

1. A padlock for attachment over a staple, which comprises:

a case having an opening for insertion of the staple;

a slide bolt within said case capable of extending through said opening to engage said staple;

a lock sleeve mounted within a cylindrical bore in said case, said lock sleeve being movable between a locked position and an unlocked position, said slide bolt being fixedly attached to said lock sleeve and extending through said opening to engage said staple when said lock sleeve is in said locked position, said lock sleeve having a retractable locking member projecting from a hole in the wall of said sleeve, said locking member being capable of fitting within an indentation on the interior bore wall to hold said lock sleeve in said locked position and capable of retracting into said hole to free said sleeve when in said unlocked position; and a lock cylinder fixedly mounted within said sleeve having an interior locking mechanism operatively connected to a camming means for forcing said locking member to project outwardly through said hole when said locking mechanism is locked and allowing said locking member to retract inwardly when said locking mechanism is unlocked.

2. A padlock as in claim 1 wherein said retractable locking member is a spherical bearing mounted within said hole.

3. A padlock as in claim 1 wherein said lock sleeve has at least three holes in its wall and has the three retractable locking members, one mounted within each hole.

4. A padlock as in claim 1 wherein said sleeve has a longitudinal groove along its side which is engaged by a retaining member projecting from the wall of said bore.

5. A padlock for attachment over a staple to lock a hasp as in claim 1 wherein said case has a rectangular recess along its exterior for fitting over said hasp, said opening extending inwardly from said recess.

6. A padlock for attachment over a staple, which comprises:

a case having an opening extending inwardly from the outer surface thereof for insertion of said staple and having a cylindrical bore which communicates with a passage which extends through said opening, said bore having an annular indentation on the interior wall thereof;

a lock sleeve mounted within said bore movable between a locked position and an unlocked position, and having an attached slide bolt which extends in said passage through said opening to engage said staple when in said locked position and having at least three retractable bearings projecting from holes in the wall of said sleeve capable of fitting within said annular indentation to hold said sleeve in said locked position and capable of retracting into said hole to free said sleeve to move within said bore when in said unlocked position; and a lock cylinder fixedly mounted with said sleeve having an interior locking mechanism operatively connected to a camming means for forcing said bearings to project outwardly through said holes when said locking mechanism is locked and allowing said bearing to retract inwardly when said locking mechanism is unlocked.

7. A padlock as in claim 6 wherein said sleeve has a longitudinal groove along its side which is engaged by a retaining member projecting from the wall of said bore.

8. A padlock for attachment over a staple to lock a hasp as in claim 6 wherein said case has a rectangular recess along its exterior for fitting over said hasp, said opening extending inwardly from said recess.

* * * * *